US011398169B2

(12) United States Patent
Huseman et al.

(10) Patent No.: US 11,398,169 B2
(45) Date of Patent: Jul. 26, 2022

(54) REMOVABLE DISPLAY SYSTEM

(71) Applicant: Huseman Consulting Engineers, LLC, Amarillo, TX (US)

(72) Inventors: Joseph Huseman, Canyon, TX (US); Trevor Ferril, Houston, TX (US); Gregory Huseman, Canyon, TX (US); Coly Whipple, Houston, TX (US)

(73) Assignee: HUSEMAN CONSULTING ENGINEERS, LLC, Amarillo, TX (US)

( * ) Notice: Subject to any disclaimer, the term of this patent is extended or adjusted under 35 U.S.C. 154(b) by 0 days.

(21) Appl. No.: 17/004,248

(22) Filed: Aug. 27, 2020

(65) Prior Publication Data

US 2021/0065593 A1 Mar. 4, 2021

Related U.S. Application Data

(60) Provisional application No. 62/892,183, filed on Aug. 27, 2019.

(51) Int. Cl.

| | |
|---|---|
| ***G09F 21/04*** | (2006.01) |
| ***G09F 7/18*** | (2006.01) |
| ***G09F 7/04*** | (2006.01) |

(52) U.S. Cl.

CPC ..... *G09F 21/041* (2020.05); *G09F 7/04* (2013.01); *G09F 7/18* (2013.01); *G09F 21/048* (2013.01); *G09F 2007/1852* (2013.01); *G09F 2007/1865* (2013.01)

(58) Field of Classification Search

None

See application file for complete search history.

(56) References Cited

U.S. PATENT DOCUMENTS

| | | | | |
|---|---|---|---|---|
| 3,245,165 | A * | 4/1966 | Podoloff | G09F 7/18 40/591 |
| 4,161,834 | A * | 7/1979 | Hendricks, Jr. | G09F 15/0006 40/606.09 |
| 5,398,437 | A * | 3/1995 | Bump, Jr. | B60Q 1/50 40/582 |
| 5,549,939 | A * | 8/1996 | Ray | G09F 21/041 428/31 |
| 6,866,237 | B2 * | 3/2005 | Dagan | A47G 1/17 248/441.1 |
| 7,937,866 | B1 * | 5/2011 | Brown | G09F 7/18 40/591 |
| 2003/0121193 | A1 * | 7/2003 | Kim | A47G 1/06 40/711 |
| 2003/0126780 | A1 * | 7/2003 | Kim | A47G 1/06 40/711 |
| 2004/0134108 | A1 * | 7/2004 | Harari | G09F 7/04 40/600 |
| 2010/0024266 | A1 * | 2/2010 | Pemberton | G09F 13/08 40/600 |
| 2011/0047838 | A1 * | 3/2011 | Peterson | G09F 3/207 40/1.5 |

(Continued)

*Primary Examiner* — David R Dunn
*Assistant Examiner* — Christopher E Veraa
(74) *Attorney, Agent, or Firm* — Pierson IP, PLLC

(57) ABSTRACT

Selectively coupling a display to a window utilizing coupling mechanisms positioned within depressions of a display to selectively couple the display to a window of an automobile to retain aerodynamic properties.

9 Claims, 12 Drawing Sheets

(56) References Cited

U.S. PATENT DOCUMENTS

| | | | | |
|---|---|---|---|---|
| 2011/0113661 | A1* | 5/2011 | Pemberton | G09F 7/04 40/541 |
| 2012/0050959 | A1* | 3/2012 | Whitehead | B43L 1/045 361/679.01 |
| 2012/0291227 | A1* | 11/2012 | Fiedler | F16B 1/0071 24/3.3 |
| 2014/0345175 | A1* | 11/2014 | Larson | F16B 47/00 40/591 |
| 2015/0300078 | A1* | 10/2015 | Porter IV | G09F 7/18 40/600 |
| 2018/0293920 | A1* | 10/2018 | McCarthy | G09F 7/18 |
| 2019/0333423 | A1* | 10/2019 | Kehoe | G09F 7/04 |

* cited by examiner

REMOVABLE DISPLAY SYSTEM

BACKGROUND INFORMATION

Field of the Disclosure

Examples of the present disclosure are related to systems and methods for selectively coupling a display to a window. More specifically, embodiments are directed towards utilizing a coupling mechanism positioned within a depression of a display to selectively couple an external display to a window of an automobile to retain aerodynamic properties and limit drag and stress concentrations caused by the display.

Background

Historically, automobile drivers have used their vehicles to display signage on their automobile. Conventionally, these displays use adhesives to position bumper stickers on the exterior of the vehicles, or utilized adhesives to position decals on the interior of the vehicles. However, in order for the adhesives to withstand weather conditions, driving conditions, etc., they have utilized strong adhesives. These strong adhesives can damage a vehicle, and take a substantial length of time to remove.

Alternatively, drivers have utilized magnets to display signage. However, due to air gaps, costs, dirt, etc. conventional displays utilizing magnets do not provide sufficient force to couple the display to the vehicle when driving at higher speeds. Furthermore, conventional magnetic displays do not stick to non-ferromagnetic surfaces and can cause damage to the body of the vehicle.

Accordingly, needs exist for systems and methods for selectively coupling a display device to a vehicle.

SUMMARY

Examples of the present disclosure are related to systems and methods for selectively coupling displays to vehicles, and forming displays to be coupled. Embodiments may utilize hook-and-loop coupling mechanisms, fasteners, magnets, or any other type of coupling mechanisms to couple and decouple the display from the vehicle.

In embodiments, a first coupling mechanism, such as loops or magnets, may be positioned within depressions on a display. The first coupling mechanisms may be adhered to the display in various layouts, such as a rectangular border, arranged circles, etc. The depressions may be shaped to correspond with a shape of the first ends of the first coupling mechanisms, and a height of the depressions may be configured to allow the second ends of the first coupling mechanisms to be recessed or coplanar with an inner surface of the display. This may allow the inner surface of the display to be positioned coplanar with an outer surface of the window.

In embodiments, an outer surface of the window may include second coupling mechanisms, such as hooks. The second coupling mechanisms may be adhered to the outer surface of the window in a similar pattern as the first coupling mechanism. Responsive to aligning the first coupling mechanisms and the second coupling mechanisms, an outer surface of the second coupling mechanisms may be embedded within the depressions on the display. This may allow the inner surface of the display to be positioned coplanar with the outer surface of the window to reduce air gaps between the inner surface of the display and the window. By reducing the air gaps, less outward force may be applied against the inner surface of the display.

The display may be configured to be attached and detached from the second coupling mechanisms. This may allow a user driving their personal vehicle for business purposes and for personal purposes to easily and selectively indicate whether or not they are driving the vehicle for business purposes.

Further embodiments may include window protection elements, such as felt coverings, to prevent the coupling mechanisms from permanently leaving adhesive residue on, or damaging the window the display is adhered to.

Further embodiments may include a folding display comprised of polycarbonate, plastics, etc. that is configured to have an outer portion, folding portion, and inner portion.

The outer portion may be configured to house first magnets of a first polarity and be positioned on an outer surface of the window. In embodiments, the first magnets may be any ferromagnetic or metallic material. The inner portion of the display may be configured to house second magnets of a second polarity and be positioned on an inner surface of the window. The folding portion may be configured to couple the outer portion and the inner portion, and be positioned over a top edge of the window. In embodiments, responsive to rolling down the window, the folding portion may be positioned atop of the window such that the outer portion and the inner portion are draped on a corresponding side of the window. This may allow the first magnets to interface with the second magnets, and the window may be rolled up.

Further embodiments may include a failsafe mechanism formed of a cord, strap, etc. that is configured to couple the outer portion with the inner portion. The failsafe mechanism may be configured to tether the inner portion with the outer portion to limit the ability of the inner portion or the outer portion from being completely detached from each other and move erratically and independent from each other. In embodiments, the cord, strap, etc. may be configured to be positioned around a window of the automobile, and wedged between the window and a frame of the automobile to maintain a portion of the cord, strap, etc. fixed in place via a clamping force.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
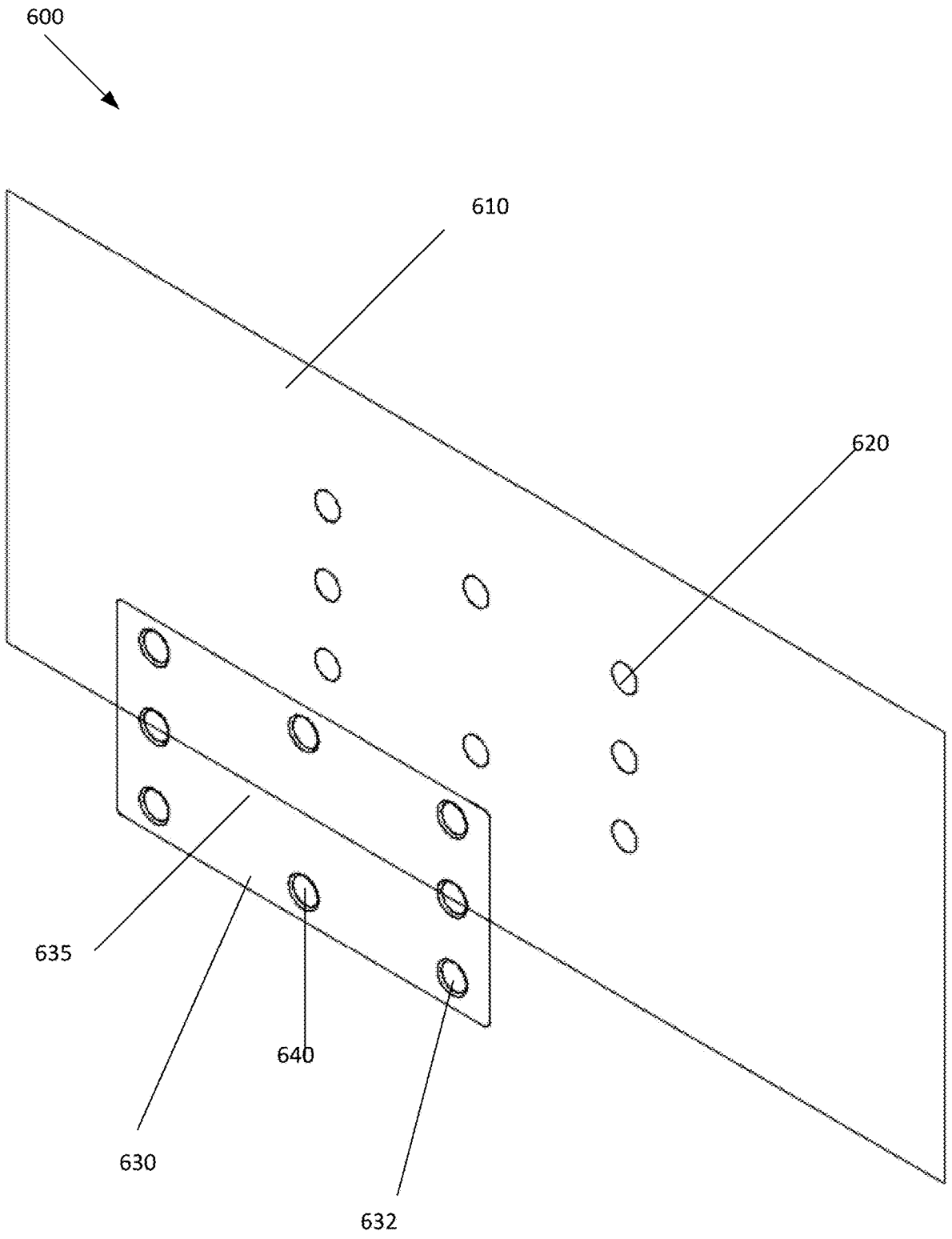
FIG. 1 depicts a perspective view of a display system configured to be selectively coupled to a window, according to an embodiment.
Figure 2:
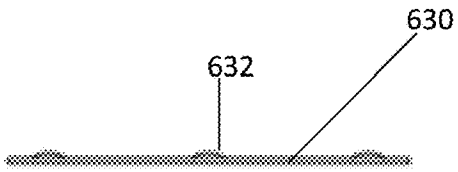
FIG. 2 depicts a top view of a display system, according to an embodiment.
Figure 4:
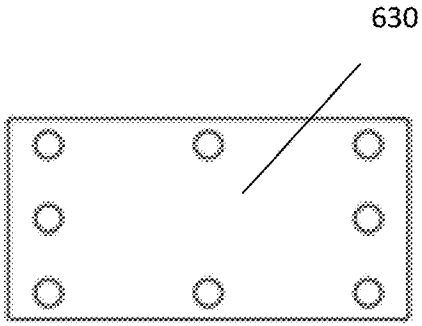
FIG. 4 depicts a rear review of a display system, according to an embodiment.
Figure 3:
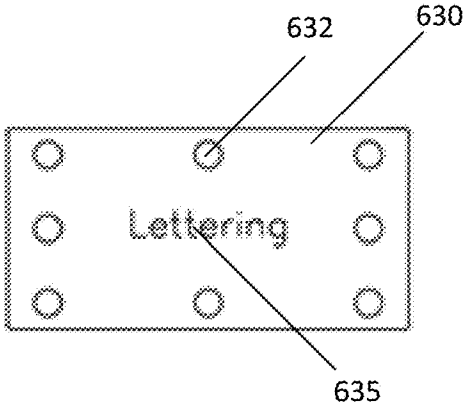
FIG. 3 depicts a front view of a display system, according to an embodiment.
Figure 5:
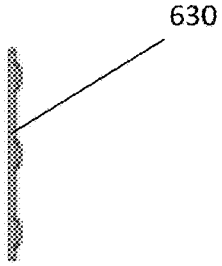
FIG. 5 depicts a side view of a display system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Additionally, any examples or illustrations given herein are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such non-limiting examples and illustrations includes, but is not limited to: "for example," "for instance," "e.g.," and "in one embodiment."

FIG. 1 depicts a perspective view of display system 600 configured to be selectively coupled to a window, according to an embodiment.

Display system 600 may be configured to be selectively displayed on a window to indicate the vehicle is on the clock, and may be used as visual proof that the vehicle is being used for work purposes. When the driver is off the clock, the driver may selectively decouple display system 600, which may serve as visual proof that the driver is no longer using the vehicle for work purposes. Display system 600 may be configured to be positioned on a window, so long as the placement of display system 600 does not obstruct a critical line of sight for the driver. As depicted in FIG. 1, display system 600 may include a window 610, first coupling mechanisms 620, display 630, and second coupling mechanisms 640.

Window 610 may be a window of a vehicle, such as a car, truck, boat, bus, etc. First coupling mechanisms 620 may be cylindrical coupling mechanism, such as loops, that are directly attached to window 610. In embodiments, a first surface of first coupling mechanisms 620 may be positioned adjacent to the outer surface of window 610, and a second surface of first coupling mechanisms 620 may project away from the outer surface of window 610. In embodiments, first coupling mechanisms 620 may be arranged in any geometrical pattern on window 610.

Display 630 may include depressions 632, which are configured to house second coupling mechanisms 640 that may be hooks. Display 630 may include a logo 635 formed with an adhesive mesh, which may be a limited vision mesh, one way mesh, privacy mesh, etc. The mesh may allow people to view through display 630 from a first direction, reflect radiation or sunlight from the first direction, etc., while allowing people to view through display 630 from a second direction. This may give thermal resistance to reduce cooling requirements from within the vehicle, while not obstructing a driver's view. The mesh may extend from an inner surface of display 630 to an outer surface of display 630.

Depressions 632 may be holes, grooves, etc. positioned on a first side of display 630, which is configured to be positioned adjacent to window 610, towards a second side of display 630, which may create a bump on second side of display 630. Depressions 632 may be arranged in the same geometrical pattern as first coupling mechanisms 620. Depressions 632 may have a circumference that is substantially the same as second coupling mechanisms 640, and may have a sufficient depth to house second coupling mechanisms 640 and first coupling mechanisms 620 when first coupling mechanisms 620 are coupled with second coupling mechanisms 640. More specifically, a depth of depressions 632 may be equal to the total height of first coupling mechanisms 620 and second coupling mechanisms 640. In embodiments, to create a depth that is sufficiently long enough, depressions 632 may extend past the second side of display 630. However, in other embodiments, depressions 632 may be not extend past the second side of display 630, which may enable a flush and planar outer surface of display 630. Furthermore, this may enable the inner surface of display 630 to be positioned directly adjacent to an outer surface of window 610 when first coupling mechanisms 620 are coupled with second coupling mechanisms 640, which may limit air gaps between window 610 and display 630.

FIGS. 2-5 depict various views of display system 600, according to embodiments. Elements depicted in FIGS. 2-5 may be described above, and for the sake of brevity a further description of these elements is omitted.

Figure 6:
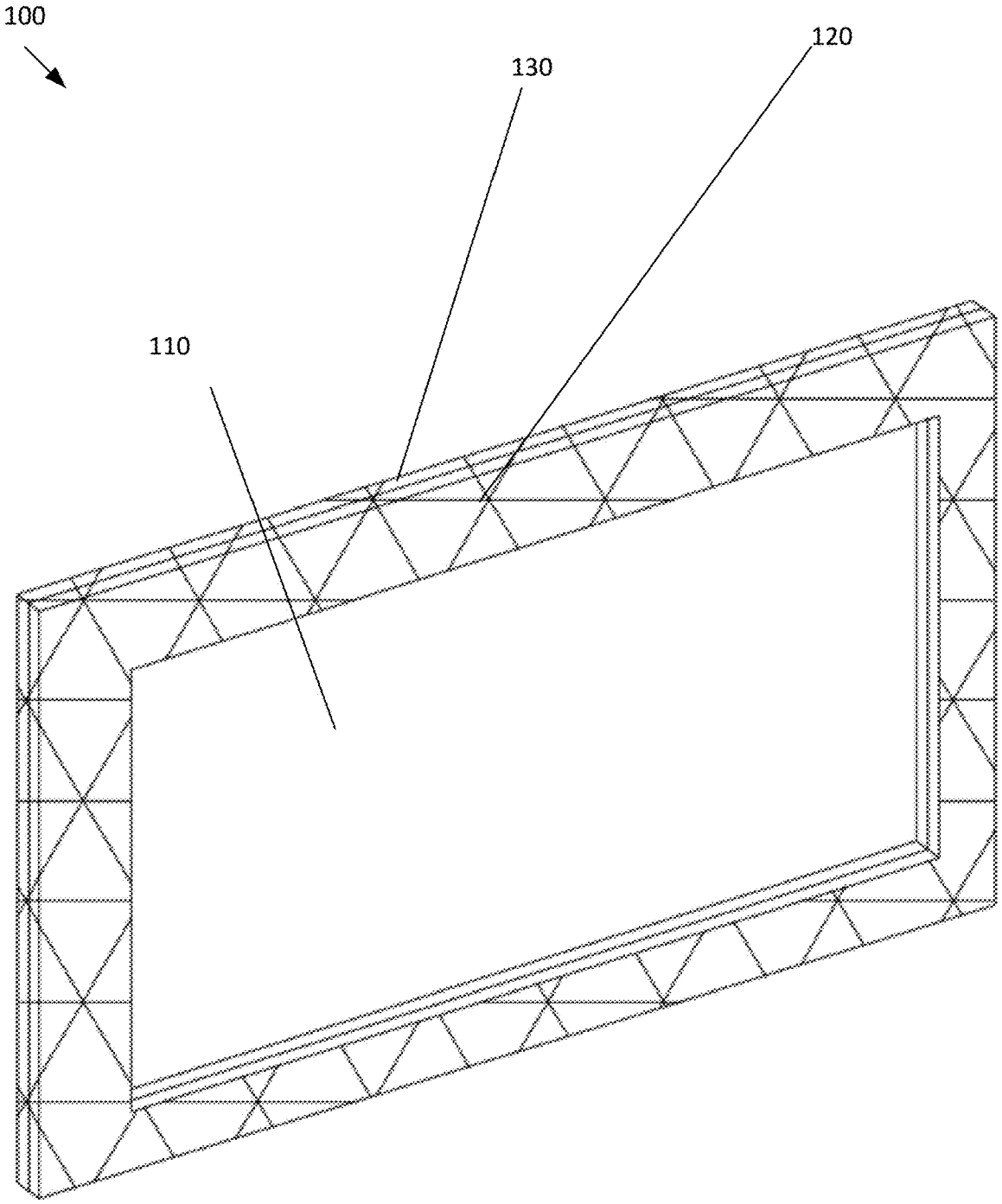
FIG. 6 depicts a perspective view of a display system configured to be selectively coupled to a window, according to an embodiment.
Figure 7:
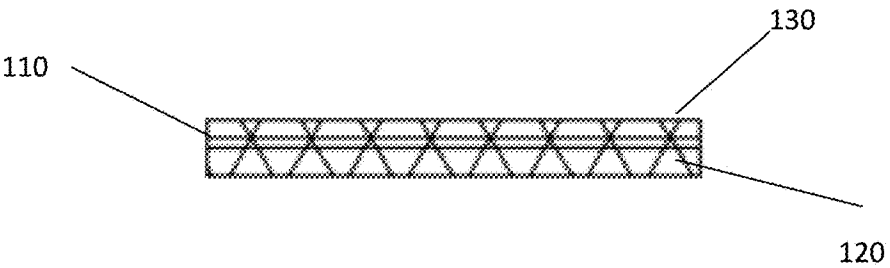
FIG. 7 depicts a top view of a display system, according to an embodiment.
Figure 10:
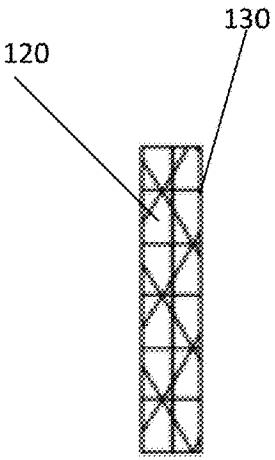
FIG. 10 depicts a side view of a display system, according to an embodiment.
Figure 9:
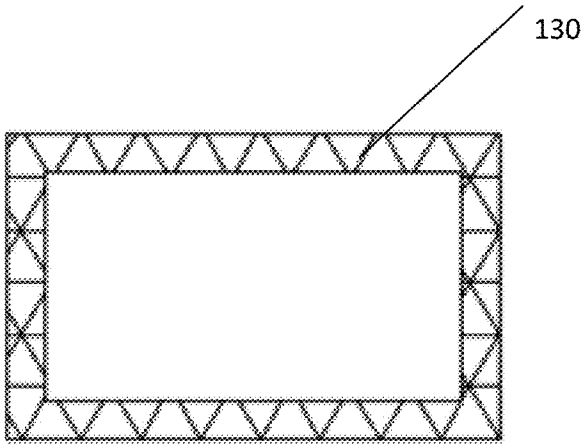
FIG. 9 depicts a rear review of a display system, according to an embodiment.
Figure 8:
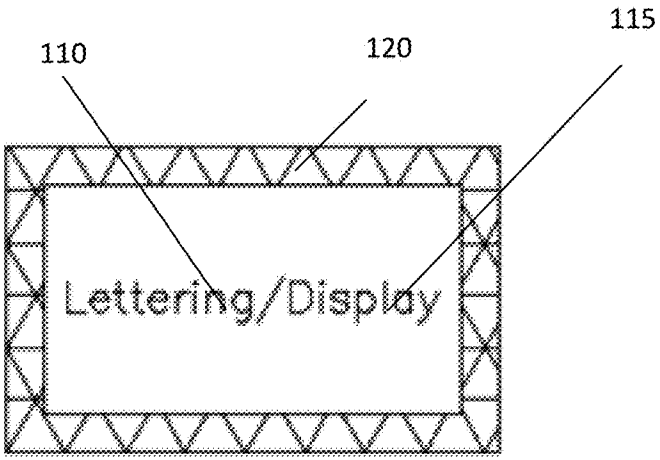
FIG. 8 depicts a front view of a display system, according to an embodiment.

FIG. 6 depicts a perspective view of display system 100 configured to be selectively coupled to a window, according to an embodiment.

As depicted in FIG. 1 display system 100 may include display 110, first coupling mechanism 120, and second coupling mechanism 130.

Display 110 may be a polycarbonate, plastic, etc. screen that is cut into a rectangular shape with rounded corners. Display 110 may have a length and width that is configured to fit within the windows of a conventional vehicle, or other movable medium. In embodiments, a logo 115, advertisement, etc. may be configured to be positioned on an outer surface of display 110. Logo 115 may be formed of an adhesive one way mesh.

First coupling mechanism 120 and second coupling mechanism 130 may be devices that are configured to be attached and detached from each other. First coupling mechanism 120 may be a hook or loop being configured to selectively interface with second coupling mechanism, which may be a hook or loop. However, in other embodiments, first coupling mechanism 120 and second coupling mechanism 130 may be any other form of coupling mechanisms that are configured to temporarily and repeatedly coupled to each other.

First coupling mechanism 120 may be configured to be adhered to a first side or a border of display 110 via epoxy, adhesives, or other fastening/coupling methods. First coupling mechanism 120 may be configured to form a border around display 110 that may be fabricated as long strips with their ends joined together to form a continuous border. In embodiments, first coupling mechanism 120 may be cut into multiple strips, including two pairs of strips that are the same length as one another. The strips may then be arranged into a rectangular border encompassing display 110, and permanently fused by heating and cooling, adhesion, or other methods.

Second coupling mechanism 130 may be configured to be adhered to an outer surface of a window via epoxy, adhesives, or other fastening methods. Second coupling mechanism 130 may be positioned on the window in a corresponding shape as first coupling mechanism 120. In embodiments, a side of second coupling mechanism 130 that is coupled to the window may include strips of wax paper or other protective, preservative material adhered to it. This may preserve the fastener's adhesive properties, while minimizing damage to the window.

Positioning first coupling mechanism 120 and second coupling mechanism 130 to have the same geometrical layout and forming a coupling location on an outermost border of display 110, may limit, reduce, etc. the possibility of air gaps between first coupling mechanism 120 and 130. This may reduce the forces applied away from the window against display 110, allowing first coupling mechanism 120 to remain attached to second coupling mechanism 130 even when the vehicle is travelling at high speeds.

FIGS. 7-10 depict various views of display system 100, according to embodiments. Elements depicted in FIGS. 7-10 may be described above, and for the sake of brevity a further description of these elements is omitted.

Turning now to FIGS. 11-15, FIG. 11 depicts a perspective view of display system 1100 configured to be selectively coupled to a window, according to an embodiment.

Figure 11:
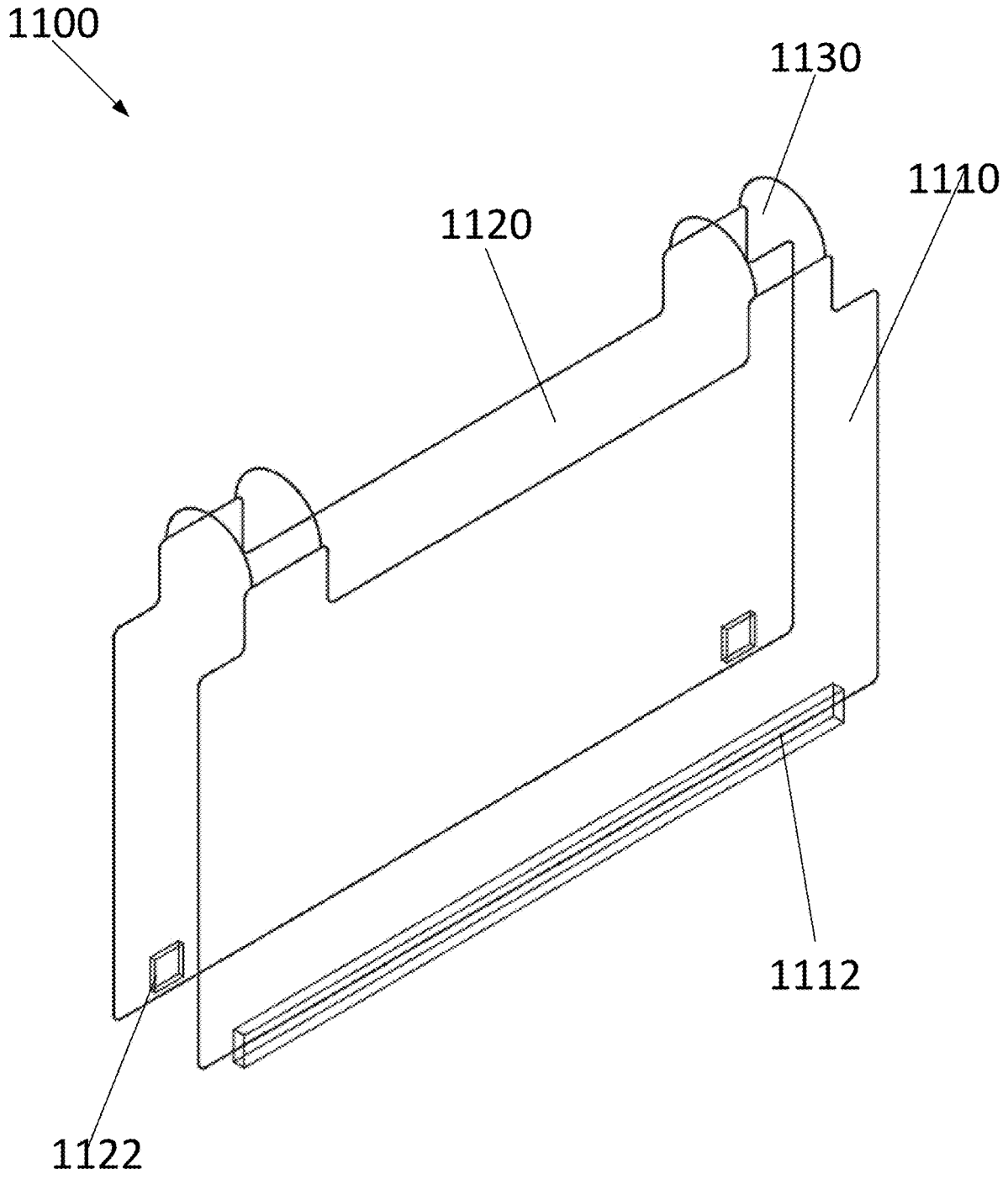
FIG. 11 depicts a perspective view of a display system configured to be selectively coupled to a window, according to an embodiment.

As depicted in FIG. 11, display system 1100 may be formed of a first surface, second surface 1120, and hinge 1130, which all may be formed of a unitary piece of polycarbonate, plastic, etc. In embodiments, display system 1100 may be cut and shaped using a laser cuter, which may be drawn or sketched using a template, manual markings, laser etching, etc. Display system 1100 may be cut into a desired shape, and lettering and/or designs may be laser etched onto an outer surface of display system 1100. Embodiments may then be smoother at the edges using an abrasive blasting, aeration device, etc. to grind edges until they are smoothed and confirmed to a uniform standard.

First surface 1110 may be configured to be positioned on an exterior of a window 1200 of a vehicle, wherein first window 1220 may be any non-magnetic screen or surface. First surface 1115 may include a logo 1110, which may be a limited vision mesh, one way mesh, privacy mesh, etc. First surface 1110 may be configured to house a first magnet, metallic object, or ferromagnetic material 1112, wherein first magnet 1112 has a first polarity or may be any metallic object. In embodiments, first magnet 1112 may extend along a lower edge of first surface 1110, or may be positioned at any desired geometric layout of position on first surface 1110. In embodiments, first surface 1110 may include fasteners to hold or secure decorations and flair. First surface 1110 may also include LED lights to allow first surface 1110 to stand out and more effectively identify a company of individual.

Second surface 1120 may be configured to be positioned on an interior of window 1200 of the vehicle. Second surface 1120 may include at least one second magnet 1122 that has a second polarity. Second magnets 1122 may be configured to align with first magnet 1112 when display system 1100 is positioned over window 1220. In embodiments, second surface 1120 may include knobs coupled to the housing that holds second magnets 1122 in place. The knobs may be configured to act as switches to control the polarity of second magnets. Responsive to rotating the knobs, second magnets 1122 may change from the second polarity to the first polarity, and vice versa. This may be utilized to couple and decouple first magnet 1112 from second magnets 1122. When the magnets are decoupled from each other, display system 1100 may be removed from window 1220.

Hinge 1130 may be positioned first surface 1110 and second surface 1120, and may be configured to rest on an upper edge of window 1200. Hinge 1130 may be configured to be formed, angled, etc. such that first surface 1110 and second surface 1130 extend substantially in parallel to each other. Hinge 1130 may be formed by folding first surface 1110 relative to second surface 1120 over a heat rod, heat gun, or other heat source that makes the display system 1100 more ductile, though controlled as to maintain the physical integrity of the unified part. Hinge 1130 may then be cooled until it solidifies. Hinge 1130 is configured to sit on the edge of window 1200 to assist in securing display system 1100 in place when the window 1200 is rolled up to the closed position. This may further assist securing display system 1100 in place when the magnetic force between first magnet 1112 and second magnets 1122 is insufficient.

In further embodiments, an inner surface of first surface 1110 may include a slot 1500, which is configured to be positioned adjacent to an outer surface of window 1200. Slot 1500 may be configured to hold and secure a removable insert. Based on the magnetic forces applied to by first magnet 1112 and second magnets 1112, a compressive force may be applied against slot 1500 from an outer surface of window 1200 and an inner surface 1110 of first surface. This compressive force may be configured to secure the removable insert within slot 1500 in place.

Figure 12:
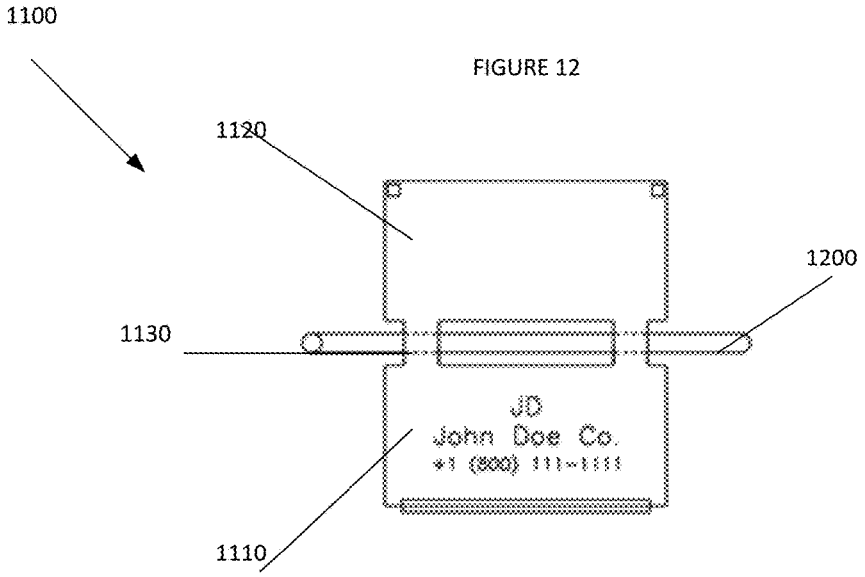
FIG. 12 depicts a top view of a display system, according to an embodiment.
Figure 13:
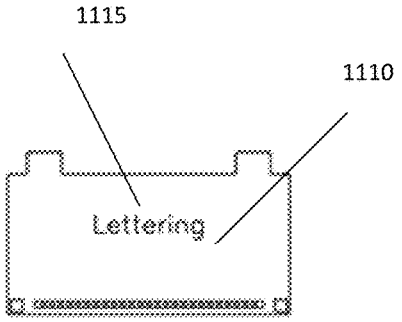
FIG. 13 depicts a front view of a display system, according to an embodiment.
Figure 14:
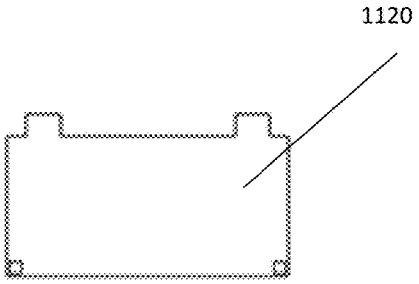
FIG. 14 depicts a rear review of a display system, according to an embodiment.
Figure 15:
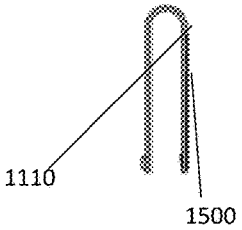
FIG. 15 depicts a side view of a display system, according to an embodiment.

FIG. 12 depicts a top view of display system 1100, FIG. 13 depicts a front view of display system 1100, FIG. 14 depicts a rear review of display system 1100, and FIG. 15 depicts a side view of display system 1100, according to an embodiment. Elements depicted in FIGS. 11-15 may be described above, and for the sake of brevity are omitted.

Figure 16:
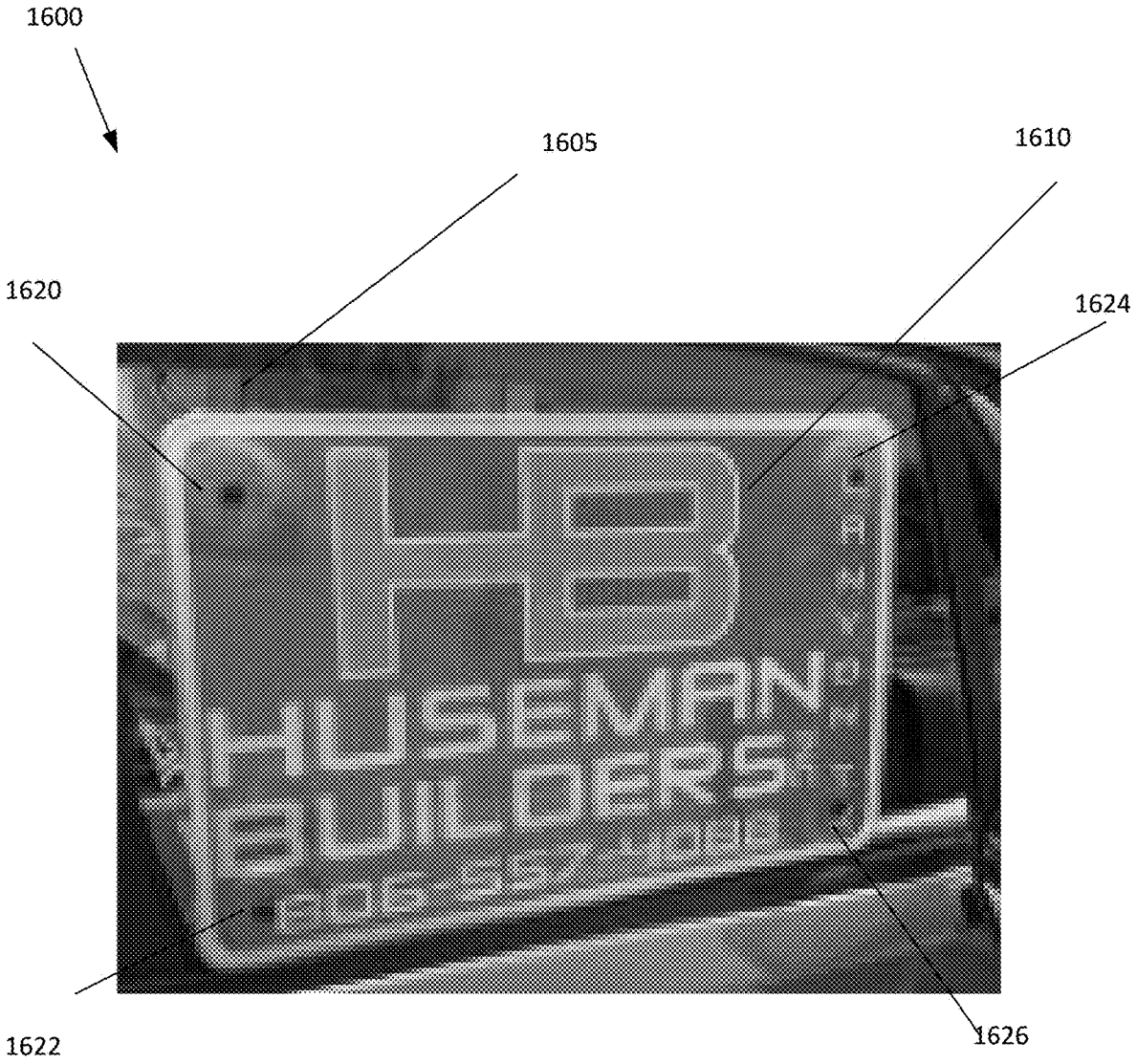
FIG. 16 depicts an external view of a display system, according to an embodiment.

FIG. 16 depicts a perspective view of a display system 1600 configured to be positioned on window 1605 of an automobile, according to an embodiment.

As depicted in FIG. 16, display system 1600 may include a display 1610, which may be an advertisement, safety notice, contact information, etc., which is configured to be positioned on an outer surface of a window 1605 to be exposed to the elements. Display 1610 may include a plurality of first coupling mechanisms 1620, 1622, 1624, 1626 that are configured to be positioned proximate to the corners of display 1610. The first coupling mechanisms may be magnets, washers, etc. formed of a first material that are configured to couple with second coupling mechanisms positioned on an internal side of window 1605. In embodiments, the first coupling mechanisms may be steel washers that are more durable material than the second coupling mechanisms, and may have a weaker magnetic force.

Figure 17:
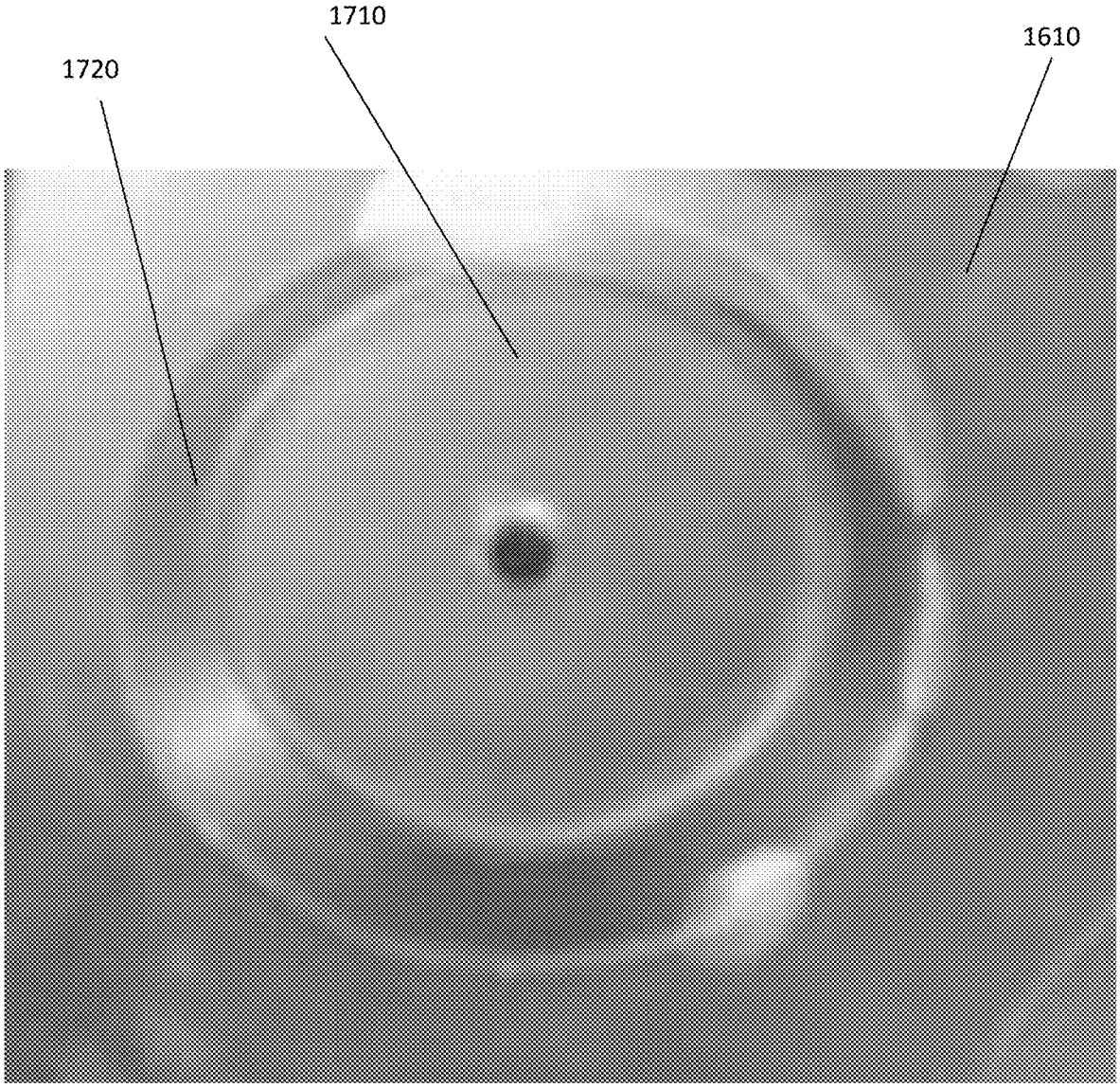
FIG. 17 depicts an external view of a display system, according to an embodiment.

FIG. 17 depicts a depression 1710 formed on an inner surface of display 1610. Depression 1710 may be configured to increase a depth of display 1610 via gradually tapered sidewalls 1720, wherein a first coupling mechanism may be embedded within the depression 1710. Due to the tapered and circular sloped sidewalls 1720, the profile of display 1610 may minimize the impact of wind flowing over and around display 1610. Namely, depression 1710 may house the first coupling mechanisms to allow the inner surface of display 1610 to be positioned adjacent to a window of the automobile.

Figure 18:
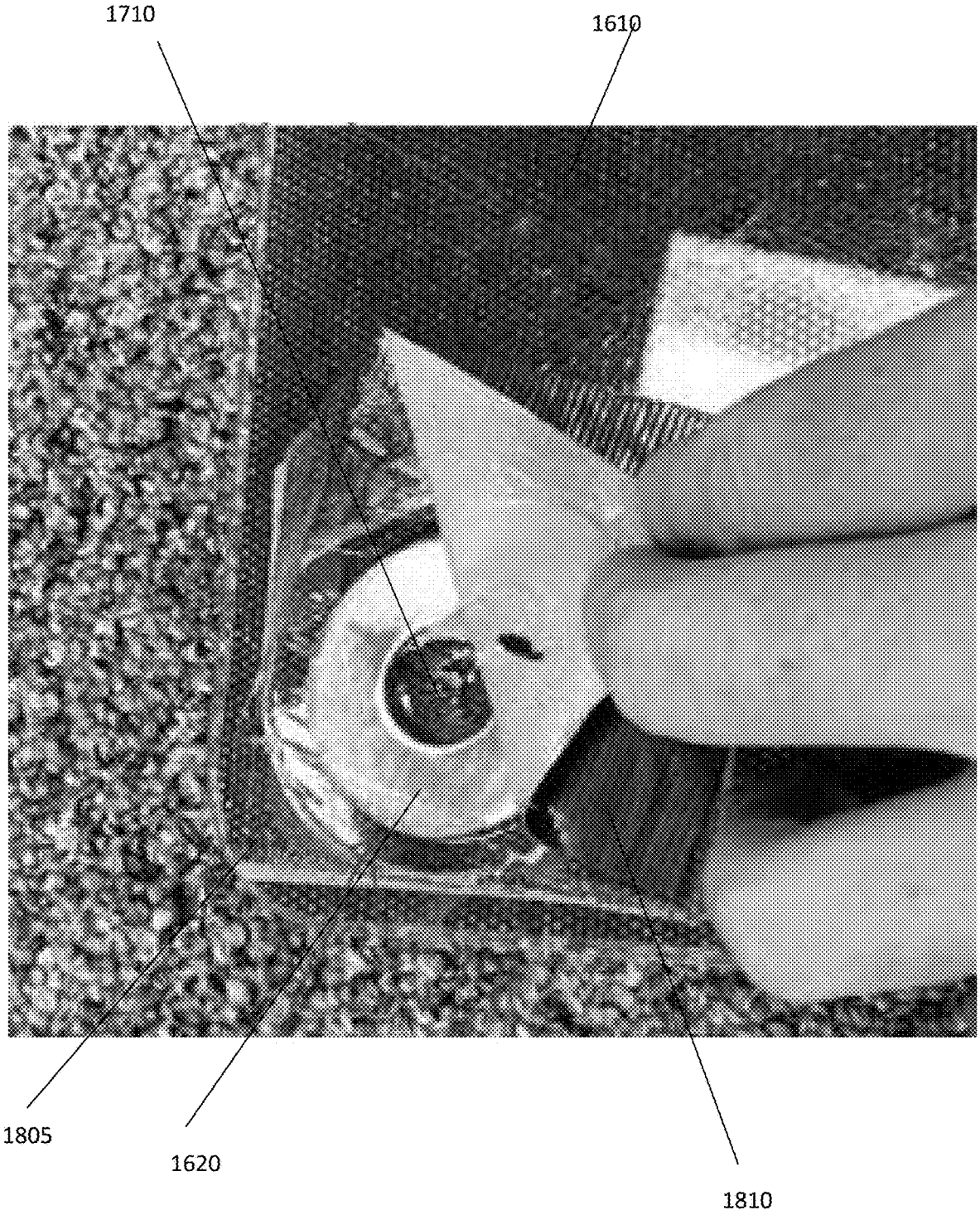
FIG. 18 depicts an internal view of a display system, according to an embodiment.

FIG. 18 depicts a first coupling mechanism 1620 embedded within depression 1710. In embodiments, an adhesive textile material 1810 may be positioned over the inner surface of display 1610 and first coupling mechanism 1620. Textile material 1810 may be any material that is produced by matting, condensing, and pressing fibers together, such as felt. Textile material 1810 may be configured to limit the interaction of first coupling mechanism 1620 on the window.

Furthermore, a molded piece of Plexiglas 1805 may be positioned over the inner surface of display 1610. Plexiglas 1805 may be configured to provide a transparent thermoplastic used in a sheet as a lightweight, shatter-resistant alternative to glass.

Figure 19:
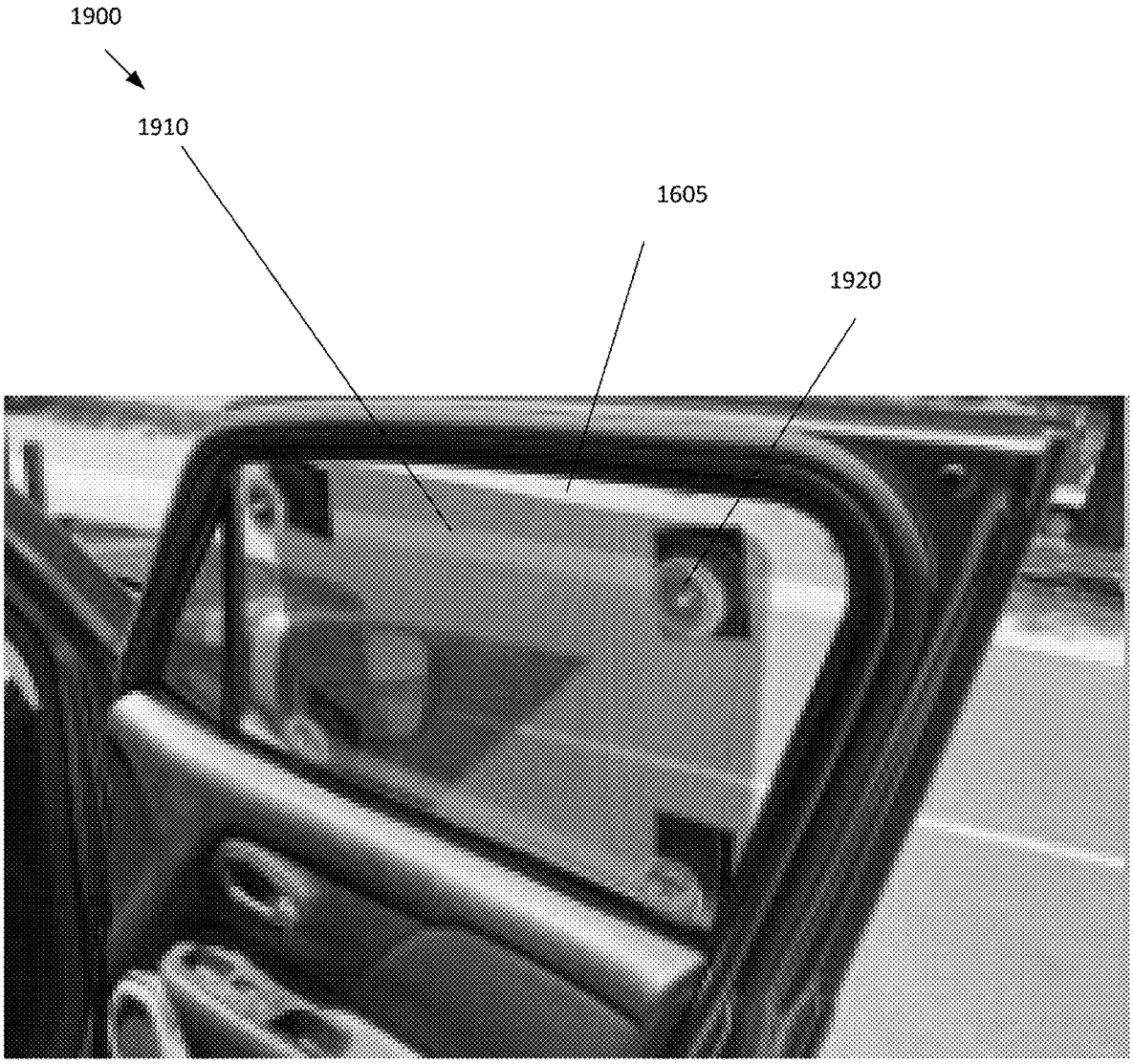
FIG. 19 depicts an internal view of a display system, according to an embodiment.

FIG. 19 depicts a portion 1900 of the display system that is configured to be positioned on an internal side of window 1605, according to an embodiment. The internal portion 1900 of display system 1600 may include a sheet of Plexiglas 1910 with a plurality of second coupling mechanisms 1920. The plurality of second coupling mechanisms 1820 may be positioned proximate to the corners of Plexiglas 1910 to align with the first coupling mechanisms. Second coupling mechanisms 1920 may be formed of a permanent magnet with a stronger magnetic field than first coupling mechanisms 1620. Due to second coupling mechanisms 1920 being internally positioned with an automobile and protected by the elements, second coupling mechanisms 1920 may be formed of a more brittle material than the first coupling mechanisms.

Figure 20:
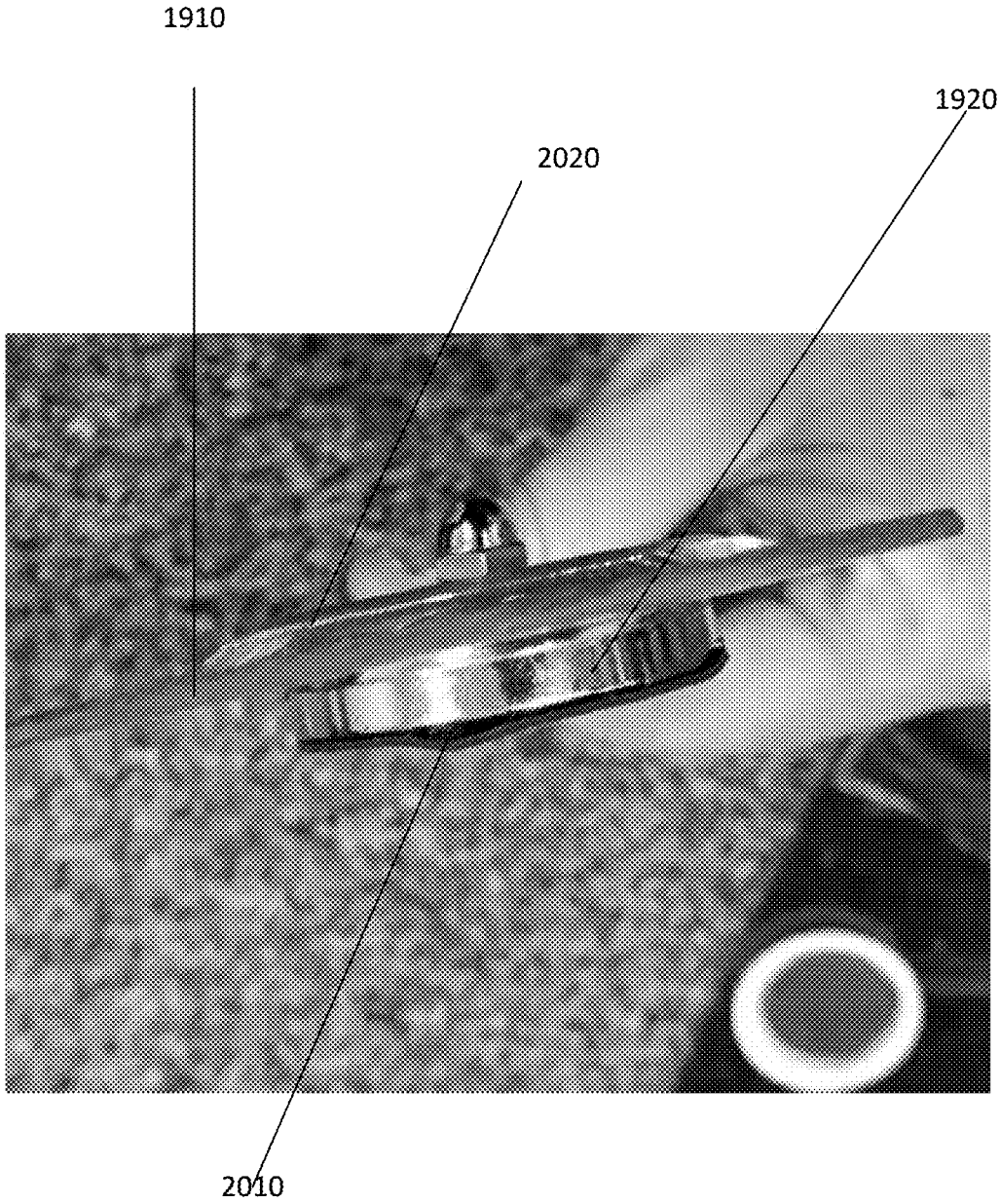
FIG. 20 depicts an internal view of a display system, according to an embodiment.

FIG. 20 depicts internal portion 1900 of the display system, according to an embodiment. As depicted in FIG. 20, internal Plexiglas 1910 may have a depression 2020 that is configured to receive an external surface of second coupling mechanism 1920, and an adhesive textile 2010 is configured to be coupled with an internal surface of second coupling mechanism 1920. In use, textile 2010 may be configured to be positioned adjacent to an internal surface of a car window, and magnetic fields between first coupling mechanisms 1620 and second coupling mechanism 1920 may couple the two together.

Figure 21:
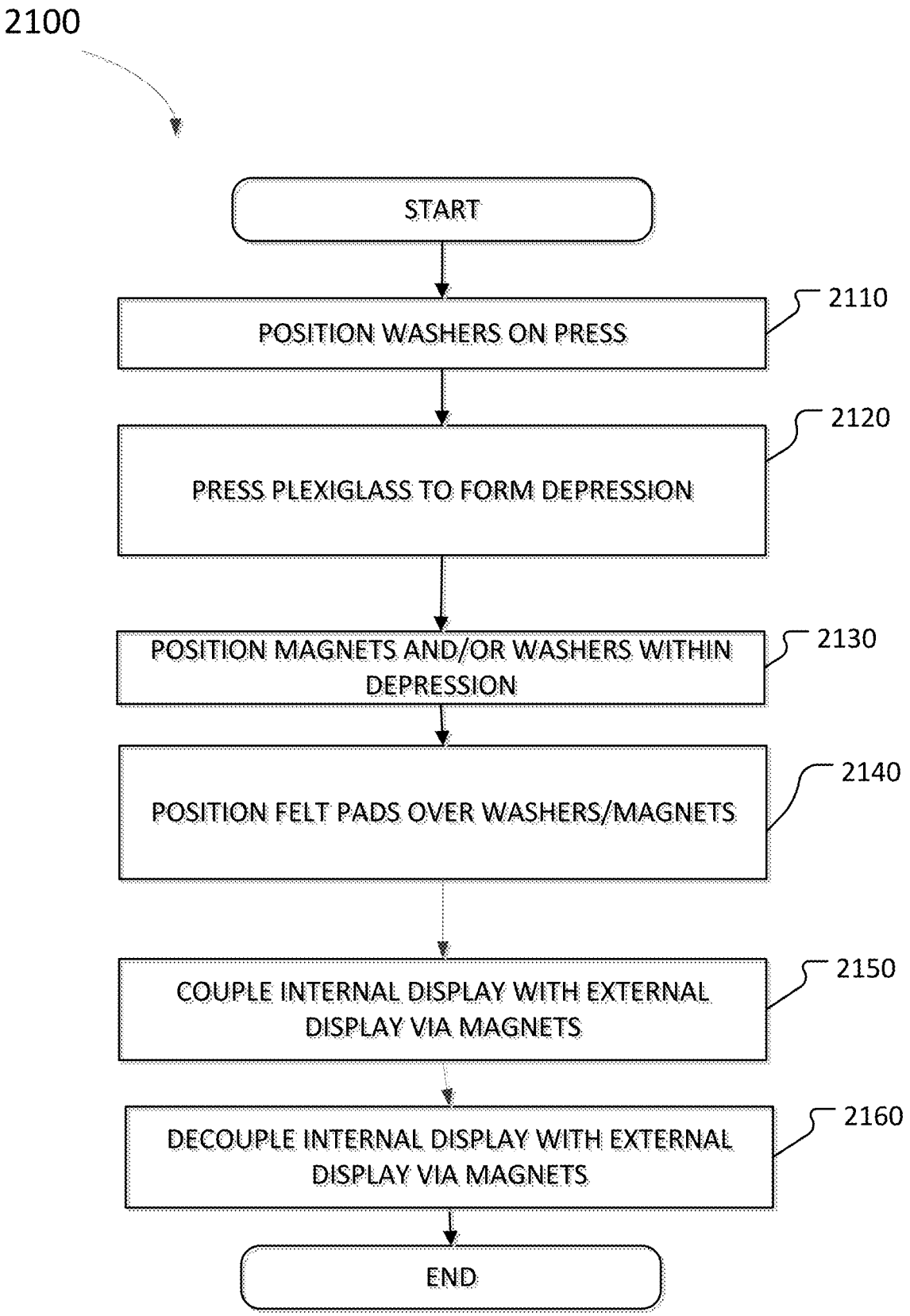
FIG. 21 depicts a method of forming a display system, according to an embodiment.

FIG. 21 depicts a method 2000 for forming a display system, according to an embodiment. The operations of method 2000 presented below are intended to be illustrative. In some embodiments, method 2000 may be accomplished with one or more additional operations not described, and/or without one or more of the operations discussed. Additionally, the order in which the operations of method are illustrated in FIG. 21 and described below is not intended to be limiting. Embodiments are not limited to a specified number of chambers, inlets, or outlets.

At operation 2010, washers may be positioned on a press. The washers may be configured to form a shape of the depression within the Plexiglas.

At operation 2120, the Plexiglas may be positioned on top of the washers on the press, and the press may apply pressure against the Plexiglas to mold the Plexiglas around the washers.

At operation 2130, washers and/or magnets may be positioned within the depression within the Plexiglas. In an embodiment, the washers may be positioned within the depressions on a first sheet of Plexiglas, and a washer and a magnet may be positioned within each of the depressions on a second sheet of Plexiglas. In embodiments, the first sheet of Plexiglas may be configured to be positioned on an external side of a car window, and the second sheet of Plexiglas may be configured to be positioned on an internal side of the car window. In embodiments, a press may be used at a rate to plastically deform the sheets of Plexiglas while reducing stress intensity to prevent cracking and other surface deformations that would decrease the lifetime of the material. The centering and positioning of the press may create a symmetrical, smooth pattern around the Plexiglas to reduce drag and vortices in an economical fashion. The location and methods of the depressions within the Plexiglas may be configured to reduce the vibration of the material preventing a critical vibration magnitude & frequency from material flying off from the window.

At operation 2140, adhesive felt pads may be positioned over the washers and/or magnets to protect the car window.

At operation 2150, the first sheet of Plexiglas may be positioned on an external side of a window, and the second sheet of Plexiglas may be positioned on an internal side of the window. Due to the magnetic fields created by the magnets and the washers, the first sheet of Plexiglas may be magnetically coupled to the second sheet of Plexiglas through the window.

At operation 2160, the first sheet of Plexiglas may be decoupled from the second sheet of Plexiglas to remove the display system from the window.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment," "an embodiment" "one example," or "an example" means that a particular feature, structure or characteristic described in connection with the embodiment or example is included in at least one embodiment of the present embodiments. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

As used herein, the terms "comprises," "comprising," "includes," "including," "has," "having," or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

What is claimed is:

1. A removable display system for a, non-magnetic window comprising:

a first screen including aligned first depressions and first protrusions, wherein an internal surface of the first screen is configured to be positioned adjacent to a first side of the non-magnetic window, the first depressions being a hollow concave inner surface on the internal surface of the first screen, the first protrusions being configured to be exposed on an external surface of the first screen, the protrusions including circular tapered sidewalls and a planar surface that are configured to reduce drag, the circular tapered sidewalls continuously and gradually decrease a radius of the protrusions from a flat portion of the external surface of the first screen to the planar surface of the protrusions, a plurality of objects of ferrous material, wherein each of the plurality of objects is configured to be positioned within the hollow concave inner surface of a different one of the first depressions, wherein a proximal surface of each of the plurality of objects is configured to be positioned adjacent to the first side of the non-magnetic window to reduce air gaps between the internal surface of the first sheet of the display and the non-magnetic window;

a second screen, with second depressions, wherein an internal surface of the second screen is configured to be positioned adjacent to a second side of the non-magnetic window;

a plurality of magnets, wherein each of the plurality of magnets is configured to be positioned in a different one of the plurality of second depressions.

2. The system of claim 1 further comprising:

adhesive felt pads are configured to be positioned on the proximal surface of each of the plurality of objects of ferrous material.

3. The system of claim 1, wherein the objects of ferrous material and the magnets are formed of different materials.

4. The system of claim 1, wherein the first recesses are symmetrical and positioned proximal to each corner of the first half.

5. The system of claim 1, wherein a strap is configured to couple the first half and the second half.

6. The system of claim 1, wherein a press is configured to create the first recesses and the second recesses.

7. The system of claim 1, wherein the first half and the second half are symmetrical sheets formed of acrylic.

8. The system of claim 1, wherein the proximal surfaces of each of the plurality of objects of ferrous material is coplanar with the internal surface of the first half.

9. A removable display system for a non-magnetic window comprising:

a first sheet including aligned first depressions and first protrusions, wherein an internal surface of the first sheet is configured to be positioned adjacent to a first side of the non-magnetic window, the first depressions including a hollow concave inner surface on the internal surface of the first sheet, and the first protrusions being exposed on an external surface of the first sheet, the first protrusions including circular tapered sidewalls and a planar surface that are configured to reduce drag, the circular tapered sidewalls continuously and gradually decrease a radius across the first protrusions from a flat portion of the external surface of the first sheet to the planar surface of the protrusion;

first coupling mechanisms positioned within the first depressions;

a second sheet with second coupling mechanisms, the first coupling mechanisms being configured to be couple with the second coupling mechanisms to selectively couple the first sheet and the second sheet.

* * * * *